US012583569B2

(12) United States Patent
Nuutinen et al.

(10) Patent No.: US 12,583,569 B2
(45) Date of Patent: Mar. 24, 2026

(54) METHOD OF CONTROLLING PROPULSION SYSTEM OF MARINE VEHICLE AND PROPULSION SYSTEM

(71) Applicant: ABB Schweiz AG, Baden (CH)

(72) Inventors: Mika Nuutinen, Helsinki (FI); Wei Ji, Stockholm (SE); Bin Liu, Västerås (FI); Veli-Pekka Peljo, Helsinki (FI); Winston Garcia-Gabin, Solna (SE); Kateryna Mishchenko, Västerås (SE)

(73) Assignee: ABB Schweiz AG, Baden (CH)

( * ) Notice: Subject to any disclaimer, the term of this patent is extended or adjusted under 35 U.S.C. 154(b) by 194 days.

(21) Appl. No.: 18/001,344

(22) PCT Filed: Jun. 11, 2020

(86) PCT No.: PCT/EP2020/066192
§ 371 (c)(1),
(2) Date: Dec. 9, 2022

(87) PCT Pub. No.: WO2021/249644
PCT Pub. Date: Dec. 16, 2021

(65) Prior Publication Data

US 2023/0234690 A1 Jul. 27, 2023

(51) Int. Cl.
*B63H 21/21* (2006.01)
*B63B 1/28* (2006.01)

(52) U.S. Cl.
CPC ..... *B63H 21/21* (2013.01); *B63B 1/28* (2013.01); *B63H 2021/216* (2013.01)

(58) Field of Classification Search
CPC ..... B63H 21/21; B63H 2021/216; B63H 2001/105; B63H 1/10; B63B 1/28
See application file for complete search history.

(56) References Cited

U.S. PATENT DOCUMENTS 5,462,406 A * 10/1995 Ridgewell ..... F03D 3/068 416/111
6,065,935 A * 5/2000 Perfahl ..... B63H 1/10 416/111
6,948,910 B2 * 9/2005 Polacsek ..... F03D 1/0608 416/227 R (Continued)

FOREIGN PATENT DOCUMENTS

CN 201525494 U 7/2010
CN 102351038 A 2/2012

(Continued)

OTHER PUBLICATIONS

CN-107187570-A machine translation (Year: 2017).*

(Continued)

*Primary Examiner* — Fadey S. Jabr
*Assistant Examiner* — Mark Robert Heim
(74) *Attorney, Agent, or Firm* — Whitmyer IP Group LLC

(57) ABSTRACT

A method of controlling a propulsion system of a marine vehicle by a controller, which forms data on a pitch angle ($\gamma(\theta)$) of at least one foil based on an angularly variable wake field ($W(\theta)$) affecting the at least one foil and an angle ($\theta$) of a rotation of the foil wheel. An actuator arrangement that receives the data from the controller sets the at least one foil at the pitch angle ($\gamma(\theta)$) based on the data.

17 Claims, 4 Drawing Sheets

(56) References Cited

U.S. PATENT DOCUMENTS

| | | | | |
|---|---|---|---|---|
| 7,686,583 | B2 * | 3/2010 | Siegel | F03B 17/067 416/111 |
| 7,762,776 | B2 * | 7/2010 | Siegel | B63H 1/08 440/93 |
| 8,231,344 | B2 * | 7/2012 | Kinzie | F03D 7/0296 416/37 |
| 9,841,003 | B2 * | 12/2017 | Curutchet | F03D 3/068 |
| 9,926,058 | B2 * | 3/2018 | Sharrow | B64C 11/00 |
| 11,352,117 | B1 * | 6/2022 | Blew | B63H 21/17 |
| 11,370,508 | B1 * | 6/2022 | Dugger | B63B 34/75 |
| 11,613,335 | B2 * | 3/2023 | Damay | B63H 1/10 440/93 |
| 2004/0048528 | A1 * | 3/2004 | Gieseke | B63H 1/08 440/93 |
| 2012/0027592 | A1 * | 2/2012 | Kinzie | F03D 7/0296 416/1 |
| 2012/0183399 | A1 * | 7/2012 | Perkinson | F03D 17/00 416/1 |
| 2012/0277941 | A1 * | 11/2012 | Noffsinger | G08G 3/00 701/21 |
| 2013/0216381 | A1 * | 8/2013 | Liu | F03D 15/20 416/79 |
| 2015/0147176 | A1 * | 5/2015 | Curutchet | F03D 3/005 416/41 |
| 2015/0321740 | A1 * | 11/2015 | Bradley | B63H 1/10 416/1 |
| 2017/0174305 | A1 * | 6/2017 | Juergens | B63H 1/10 |
| 2019/0009872 | A1 * | 1/2019 | Borel | B63H 5/10 |
| 2019/0264568 | A1 * | 8/2019 | Kislinger | F01D 5/142 |
| 2020/0055581 | A1 * | 2/2020 | Sánchez-Caja | B63J 99/00 |
| 2022/0009300 | A1 * | 1/2022 | Benedict | B63H 3/00 |

FOREIGN PATENT DOCUMENTS

| | | | | |
|---|---|---|---|---|
| CN | 105083515 | A | 11/2015 | |
| CN | 107187570 | A * | 9/2017 | B63H 1/36 |
| CN | 107187570 | B | 4/2019 | |
| DE | 20117451 | U1 | 4/2002 | |
| DE | 10060067 | A1 * | 6/2002 | B63H 1/10 |
| EP | 2977311 | A1 * | 1/2016 | B63H 1/37 |
| EP | 2944556 | B1 * | 7/2018 | B63H 1/10 |
| JP | 2007246082 | A | 9/2007 | |
| KR | 1020070093814 | A | 9/2007 | |

OTHER PUBLICATIONS

DE-10060067-A1 machine translation (Year: 2002).*

Epps et al. A viscous vortex lattice method for analysis of cross-flow propellers and turbines, International Journal Renewable Energy (Year: 2019).*

International Preliminary Report on Patentability; Application No. PCT/EP2020/066192; Issued: Sep. 26, 2022; 8 Pages.

International Search Report and Written Opinion of the International Searching Authority; Application No. PCT/ EP2020/066192; Completed: Mar. 1, 2021; Mar. 10, 2021; 12 Pages.

Written Opinion of the International Preliminary Examining Authority; Application No. PCT/EP2020/066192; Issued: May 18, 2022; 9 Pages.

Bakhtiari, Mohammad; "A 2.5D numerical study on open water hydrodynamic performance of a Voith-Schneider propeller"; Mechanics & Industry, France, EDP Sciences, vol. 20, No. 6; Nov. 29, 2019; 12 Pages.

Japanese Office Action; Application No. 2022-575938; Completed: Nov. 28, 2024; Issued: Dec. 3, 2024; 6 Pages.

Chinese Office Action; Application No. 202080104229.3; Completed: Dec. 19, 2024; Mailing Date: Dec. 23, 2024; 18 Pages.

* cited by examiner

METHOD OF CONTROLLING PROPULSION SYSTEM OF MARINE VEHICLE AND PROPULSION SYSTEM

TECHNICAL FIELD

The invention relates to a method of controlling a propulsion system of a marine vehicle and a propulsion system.

BACKGROUND

A marine vehicle may move with respect to water around it with thrust from a propulsion system, which includes one or more rotating foil wheels with individually controllable foils that extend vertically downwards. With individual foil pitch control, a typical a propulsion system works with a relatively high efficiency. The efficiency is based on an optimization of a pitch angle of the foils using either a trochoidal path, which depends on a function having a constant eccentricity and a rotation angle of the foil wheel as arguments, or a path described by a variable eccentricity and trigonometric functions having the rotation angle of the foil wheel as an argument.

However, as the prior art performs a mere parametric optimization but does not properly take into account the real world conditions, a result of optimized model coefficients is obtained for a single operating point only such as speed or thrust only. If another operating point is required, the model coefficients need to be optimized again for the best performance. This is a tedious process and eventually a numerical map for all model coefficients would be required to cover the entire operating range. All in all, such a process is impractical or even impossible, which may eventually lead to a low efficiency and thrust, wear of the propulsion system and high fuel consumption, which in turn may increase pollution and even health risks.

Hence, an improvement would be welcome.

SUMMARY

The present invention seeks to provide an improvement in the control.

The invention is defined by the independent claims. Embodiments are defined in the dependent claims.

BRIEF DESCRIPTION OF THE DRAWINGS

Example embodiments of the present invention are described below, by way of example only, with reference to the accompanying drawings, in which.

DETAILED DESCRIPTION

The following embodiments are only examples. Although the specification may refer to "an" embodiment in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may also contain features/structures that have not been specifically mentioned. All combinations of the embodiments are considered possible if their combination does not lead to structural or logical contradiction.

It should be noted that while Figures illustrate various embodiments, they are simplified diagrams that only show some structures and/or functional entities. The connections shown in the Figures may refer to logical or physical connections. It is apparent to a person skilled in the art that the described apparatus and/or system may also comprise other functions and structures than those described in Figures and text. It should be appreciated that details of some functions, structures, and the signalling used for measurement and/or controlling are irrelevant to the actual invention. Therefore, they need not be discussed in more detail here.

Figure 1:
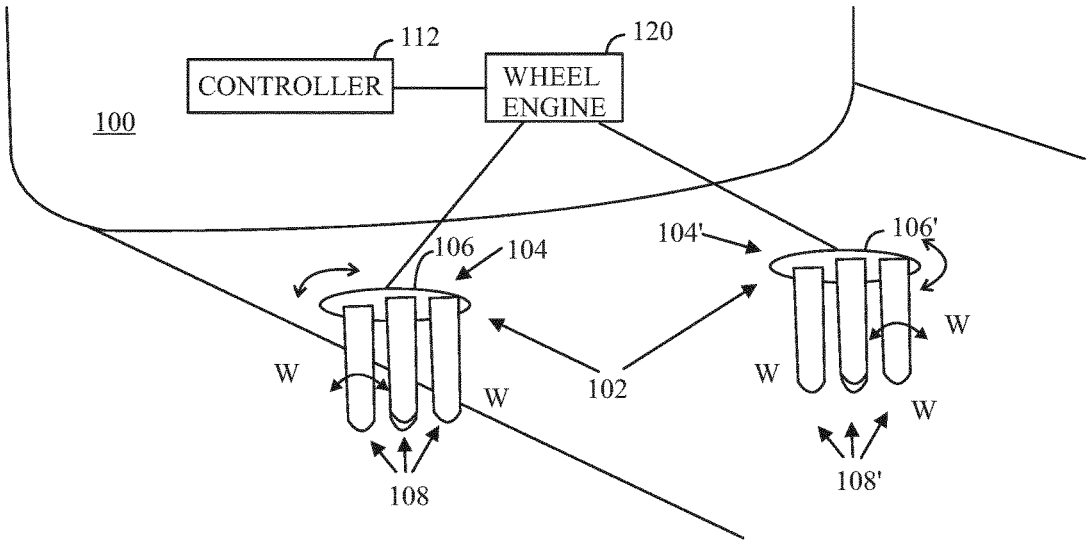
FIG. 1 illustrates an example of a marine vehicle.

FIG. 1 illustrates an example of a marine vehicle 100 (the marine vehicle is only partly shown in FIG. 1) with a propulsion system 102, which comprises two propulsion sub-systems 104, 104'. In general, the propulsion system 102 may comprise one or more propulsion sub-systems 104, 104'. Marine vehicles may include transport vessels and passenger ships. The transport ships may include cargo vessels and containers, for example. Additionally, the marine vehicles may refer to fishing vessels, service craft like tugboats and supply vessels, and warships. Furthermore, the marine vehicles may be used as ferries and submarines.

Each of the propulsion sub-system 104, 104' comprises a foil wheel 106, 106', Each of the foil wheels 106, 106', in turn, comprises at least one foil 108, 108'. A foil 108, 108' is a blade that extends downwards from the foil wheel 106, 106'. At least one of the foils 108, 108' is individually controllable and in a rotatable manner attached with the foil wheel 106, 106'. Typically all the foils 108, 108' are individually controllable in a rotatable manner with respect to the foil wheel(s) 106, 106'.

As illustrated in the example of FIG. 1, a wheel engine system 120 may be common to a plurality of the propulsion sub-systems 104, 104' through a mechanical power transmission.

Figure 2:
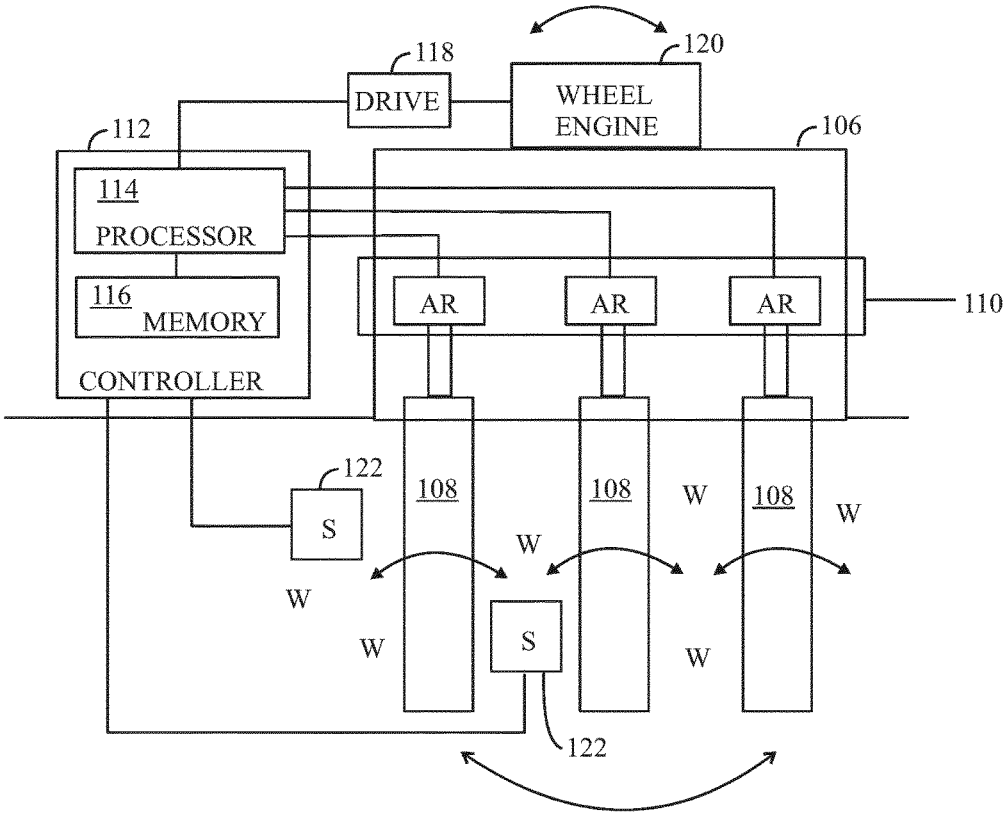
FIG. 2 illustrates an example of a propulsion system.

FIG. 2 illustrates an example where the propulsion system 102 comprises one foil wheel 106. That is, the propulsion system 102 may be correspond to one of the propulsion sub-systems 104, 104'. Additionally, the propulsion system 102 comprises an actuator arrangement 110 and a controller 112. The controller 112 may be common to all propulsion sub-systems 104, 104' (see FIG. 1) or the controller 112 may comprise a sub-controller for each of a plurality of propulsion sub-systems 104, 104' (such a possibility is illustrated in FIG. 2 although the controller 112 in FIG. 2 may also be for a plurality of foil wheels).

The controller 112 comprises one or more processors 114 and one or more memories 116 including computer program code. The one or more memories 116 and the computer program code causes the controller 112, with the one or more processors 114, to form data on a pitch angle $\gamma(\theta,t)$ of at least one foil 108 based on an angle $\theta$ of a rotation of the foil wheel 106, to which the at least one foil 108 is mechanically connected, and an angularly variable wake field W, which naturally depends also on time and affects the at least one foil 108, the angular dependence coming from the angle θ of the rotation of the foil wheel 106. This may be mathematically expressed as: $\gamma(\theta(t))=J(\theta(t), W(\theta(t))$ or shorter $\gamma(\theta)=J(\theta, W(\theta))$, where J is a function or an operation that models the pitch angle $\gamma(\theta)$ of the foil(s) 108, 108', t is time, and the angle θ of a rotation of the foil wheel 106 and $W(\theta(t))$, which is the temporally variable wake field W, are its arguments.

Figure 3:
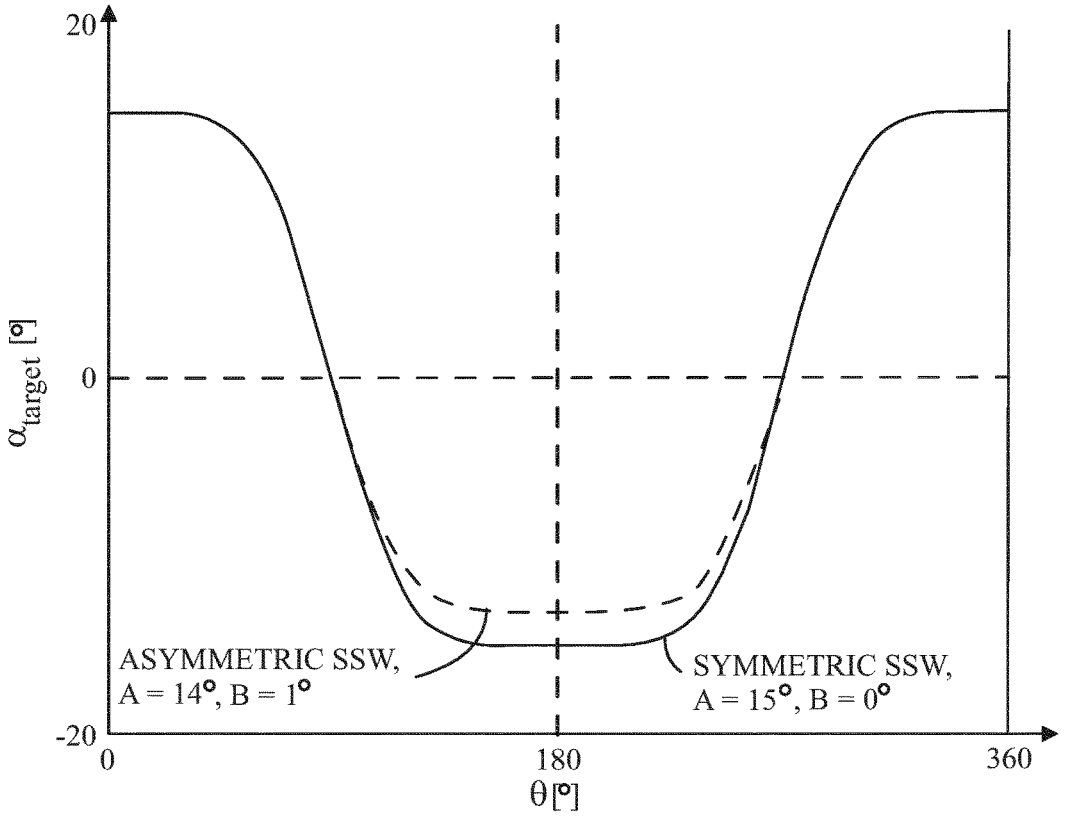
FIG. 3 illustrates an example of a symmetric smooth square wave and an asymmetric smooth square wave.

The pitch angle of a foil $\gamma(\theta)$ may also be called a foil pitch trajectory because it is a function of a rotation angle θ of the foil wheel and it forms a curve (see FIG. 3). The wake field W may be determined as a velocity field of water relative of the marine vehicle 100. The wake field W can be considered to refer to a field of laminar or turbulent currents of water. The wake field W may be caused by the at least one foil 108 of the same or different foil wheel 106, the one or more foils 108, 108', and/or a hull of the marine vehicle 100. Additionally, the wake field W may be caused by streams in the water, the streams having a source different from the marine vehicle 100 itself. The streams in the water may be generated by a river, a tide, other marine vehicle(s) and/or wind(s). The streams in the water may also vary and cause a variable wake field W due to a bottom shape under the water although that is not the source of the streams. In the prior art, the models for controlling the pitch angle $\gamma(\theta)$ have had no direct link to the underlying physics. By incorporating the wake field W in the model, it is possible to find a more realistic control of any foil of the propulsion system 102.

The controller 112 then communicates the data on the pitch angle $\gamma(\theta)$ to the actuator arrangement 110, which sets the at least one foil 108 at the pitch angle $\gamma(\theta)$ based on the data formed by the controller 112. The data may include parameters for the pitch angle and/or at least one value for the pitch angle. The actuator arrangement 110 may comprise an electric motor arrangement AR for each of the at least one foil 108. The electric motor arrangement AR may comprise a regulator and an electric motor, which turns the foil it is mechanically coupled with according to the pitch angle $\gamma(\theta)$ from the regulator, which received the data on the pitch angle $\gamma(\theta)$ from the controller 112. What is explained for the foil wheel 106 and foils 108 of FIG. 2 may correspondingly be applied also to the foil wheel 106' and foils 108' in FIG. 1.

Instead of a tedious process of several CFD (Computational Fluid Dynamics) simulations per operating point and a numerical map for all model coefficients, the optimal pitch angle can simultaneously produce a high efficiency and a small (compared to thrust) side force in straight ahead operation. That is, both issues can be addressed together. This new routine produces an optimal pitch angle of a foil in the ship's wake, unlike the prior art mere parametric optimizations restricted to open water conditions only.

The controller 112 may also control a drive 118 of a wheel engine system 120. The wheel engine system 120 may comprise an engine, which may comprise an electric engine, a combustion engine such as a diesel engine, petrol engine or a gas engine, and potentially a mechanical gearbox. The controller 112 may send a command to the drive 118 which may then control a rotation speed and/or a direction of rotation of the wheel motor 120. The wheel engine system 120 rotates the foil wheel 106 directly or through the gearbox. However, these kinds of details of the wheel engine system 120 are less relevant to the actual invention and a person skilled in the art is familiar with various wheel engine systems 120, per se. Therefore, they are not discussed in more detail here. As illustrated in an example of FIG. 2, each of the propulsion sub-systems 104, 104' may have its own wheel engine system 120.

In an embodiment, the controller 112 may be connected with at least one sensor 122, which measures the wake field W in the water when the marine vehicle 100 is operating on the sea, river or lake, for example. Then the at least one sensor 122 may communicate the data on the wake field W to the controller 112 in a wired or wireless manner. The at least one sensor 122 is suitably located with respect to the at least one foil 108 in order to measure the wake field W affecting each of the at least one foil 108 as a function of time and location (see also FIG. 5 and its description). The controller 112 may form an estimate of the wake field W at and/or adjacent to the at least one foil based on values measured by the at least one sensor 122.

Figure 5:
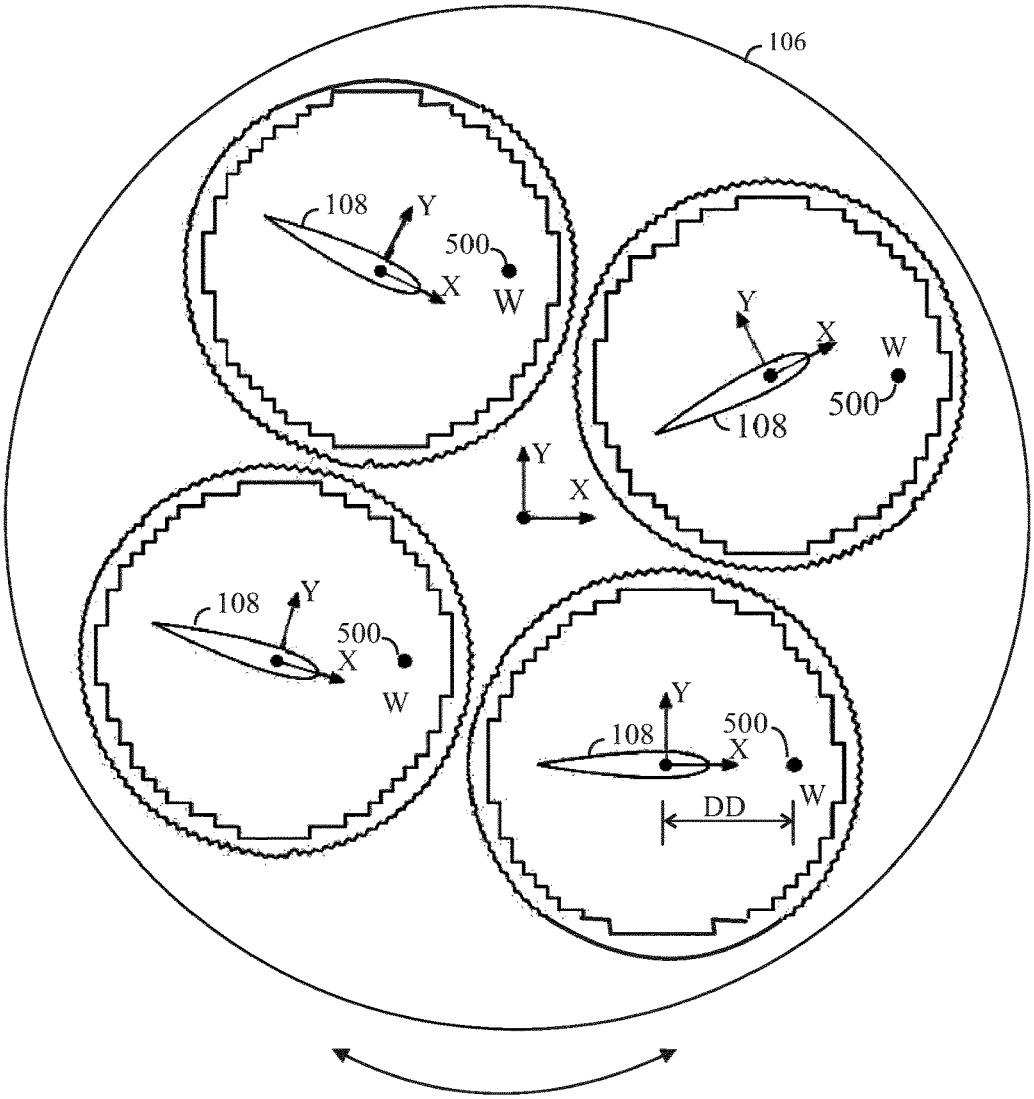
FIG. 5 illustrates an example of positioning the computational probes or sensors adjacent to at least one foil.

In an embodiment, the wake field W may be based on a simulation of water movements, around and affecting the at least one foil 108, caused by the propulsion system 102 in the water (see also FIG. 5 and its description). Hence, the wake field W may be based on a simulation of water movements, around and affecting the at least one foil 108, caused by one or more foils 108, 108'.

As already explained the propulsion system 102 of a marine vehicle 100 can be controlled by the controller 112, which forms the data on the pitch angle $\gamma(\theta)$ of the at least one foil 108, 108' based on the angle θ of a rotation of the foil wheel 106 and the temporally variable wake field W affecting the at least one foil 108, 108'. A strength of the wake field W affecting the at least one foil 108, 108' is location dependent in addition to the temporal dependency, and that is why the controller 112 provides new data on the pitch angle $\gamma(\theta)$ repeatedly or continuously for adjusting the pitch angle of the at least one foil 108, 108'. The angle θ of a rotation of the foil wheel 106 is also temporally varying when the foil wheel 106 is rotating.

In an embodiment, the controller 112 may form the data on the pitch angle $\gamma(\theta)$ of the at least one foil 108, 108' under influence of the wake field W, which is at least partly caused by propulsion of the propulsion system 102. The wake field W may have been caused by the foils 108, 108' and/or the foil wheel 106, 106'.

In an embodiment, the controller 112 may form the data on the pitch angle $\gamma(\theta)$ of a foil under influence of the wake field W, which is at least partly caused by at least one other foil. The at least one other foil and the foil 108, for which the data on the pitch angle $\gamma(\theta)$ is formed, are attached to the same foil wheel 106 in this example. Here the at least one other foil is a foil, which is different from the one for which the data on the pitch angle $\gamma(\theta)$ is formed.

In an embodiment, the controller 112 may form the data on the pitch angle $\gamma(\theta)$ of the at least one foil 108 under influence of the wake field W, which is at least partly caused by a hull of the marine vehicle 100. The movement of the marine vehicle 100 namely causes also movement of water such as currents or streams around and adjacent to the marine vehicle 100.

In an embodiment, the controller 112 may form the data on the pitch angle $\gamma(\theta)$ of the at least one foil under influence of the wake field W, which is at least partly caused by environment of the marine vehicle 100. The environment may include at least one of the following: a river, a tide, at least one other marine vehicle, wind and/or a bottom shape under the water. Although the wind does not directly cause a part of the wake field W, the wind causes water to move as currents or streams which may be taken into account in the wake field W.

In an embodiment, the controller 112 may form the data on the pitch angle $\gamma(\theta)$ for each of a plurality of foils 108 individually controllable and attached in a rotatable manner to the foil wheel 106. That is, all the foils 108, 108' of the propulsion system 102 may be controlled.

In an embodiment, the controller 112 may form the data on the pitch angle $\gamma(\theta)$ of at least one foil 108 under influence of the wake field W caused at least partly by a plurality of propulsion sub-systems 104, 104' of the propulsion system 102, the propulsion sub-systems 104, 104' comprising foils 108, 108' attached therewith including the at least one foil.

In an embodiment, the controller 112 may form the data on the pitch angle $\gamma(\theta)$ of at least one foil 108 while keeping an absolute angle of attack $\alpha$ of the at least one foil 108 constant within a tolerance for a maximized length of rotation of the foil wheel 106. The term absolute, which may also be called modulus, refers to a non-negative value of the angle of attack $\alpha$ regardless of its sign. Mathematically, the absolute value of the angle of attack $\alpha$ may be written as $|\alpha|$. The tolerance, in turn, may be predetermined. The tolerance may alternatively or additionally depend on a resolution of the data processing, mechanical settings and/or allowable mechanical limit(s) or variation of the limit(s). The tolerance may be any combination of these or the like, for example. In an embodiment, the controller 112 may form the data on the pitch angle $\gamma(\theta)$ of at least one foil 108 while keeping the angle of attack $\alpha$ of the at least one foil 108 at alternative constants for a maximized length of rotation of the foil wheel 106, the constants having opposite signs. This angle of attack may apply to the symmetric square wave target, for example. The angle of attack $\alpha$ may be an estimation formed by the model, or the angle of attack $\alpha$ may be a measured value.

In the prior art, basic pitch angle of a foil has been described by a trochoidal path $$\gamma(\theta) = a\tan\left(\frac{\cos(\theta)}{r^{+} - \sin(\theta)}\right),$$

where atan( ) is an inverse function of a tangent function, $\gamma$ is the foil pitch angle relative to x-axis (the direction of travel, see FIG. 3), $\theta$ is the foil wheel rotation angle measured counter clockwise from the x-axis, and $r^{+}$ is the eccentricity (a constant in this kind of prior art example), used to control the pitch angle of a foil. The foil wheel 106, 106' is assumed to rotate in the positive $\theta$ direction with angular speed $\omega$. With trochoidal foil pitch trajectories have attained computational (with CFD) efficiencies around $\eta$=0.8. In another prior art example, the pitch angle of a foil has a varying eccentricity $r^{+}$ as a function of the foil wheel rotation angle $\theta$, and finding the optimal coefficients $r_0^{+}$ $A_1$, $A_2$, $\alpha_1$ and $\alpha_2$ in an assumed functional form $r^{+}=r_0^{+}+(1+A_2\cos(\theta+\alpha_2))\ A_1\ \sin(2\theta+\alpha_1)$. With this optimization, no restrictions for the produced thrust was set. The advanced pitch angle of a foil of this model does not follow the trochoidal formulation, but instead the foil pitch angle is given directly as a series of trigonometric functions: $\gamma(\theta)=\Sigma_{n=0}^{N} c_n \sin[n(\theta+\varphi_n)]$. The amplitudes $c_n$ and phase angles ($\varphi_n$ are optimized for best efficiency with a given thrust target. Hence, this method is more versatile than the earlier one for a single foil. However, both of the above mentioned optimization methods and the prior art optimizations in general have the same restriction: there is no direct link to the underlying physics and thus they do not take into account the wake field W, which now can be taken into account in a following fashion.

It may be considered that a foil profile in transversal motion with respect to the incident flow has a single angle of attack $\alpha$ that produces a peak efficiency. Thus in such an embodiment, the data on the pitch angle $\gamma(\theta)$ of at least one foil 108, 108' may be formed while keeping the angle of attack $\alpha$ of the at least one foil 108, 108' close to this optimal constant value for a maximized length of rotation, in a manner allowing the sign of the angle alternate, as shown in FIG. 3 for the smooth square wave target function for the angle $\alpha$ of attack. . . In an embodiment, the angle of attack $\alpha$ of the at least one foil 108, 108' is kept at the optimal constant value for a maximized length of rotation. In an embodiment, the angle of attack a of the at least one foil 108, 108' is kept within a predetermined range from the optimal constant value for a maximized length of rotation. The maximization of the length may be included in the model function or the maximization may be caused by a maximizing operator performing the maximization of the model function. The maximization of the length of rotation of the foil wheel 106, 106' with a constant angle of attack is prior art, per se.

In an embodiment, the optimum angle of attack $\alpha$ may lead to a peak efficiency up $\eta$=0.9 and gradual decrease with smaller and higher angles. On the other hand, the angle of attack $\alpha$ cannot obviously be constant over the whole foil rotation(360°) of the foil wheel 106, 106' but, in order to produce positive thrust, the angle of attack $\alpha$ is positive while the foil 108, 108' is moving in positive y-direction (the leading side) and negative while the foil 108, 108' is moving in negative y-direction (the trailing side). A smooth square wave ssw is proposed for the base shape of the target angle of attack $\alpha_{target}$:

$$\alpha_{target} = A\left(1 + \frac{B}{A}ssw\right)ssw, \tag{1}$$

where ssw is $$ssw = \cos\left(\theta - \frac{1}{2}\sin(2\theta)\right).$$

Figure 6:
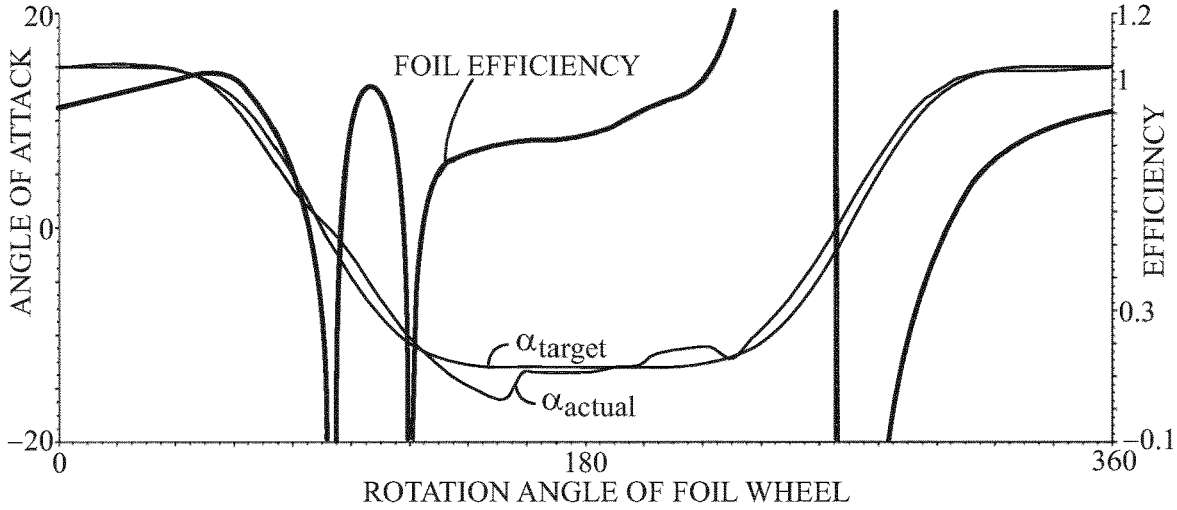
FIG. 6 illustrates an example of instantaneous foil efficiency, a target angle of attack and an actual angle of attack.

This profile with exemplary amplitudes A=14° and B=1° is presented in FIG. 3 using the dashed curve. The use of this asymmetric smooth square wave for side force adjustment may be elaborated in an embodiment (see FIG. 6 and the description related to it). The continuous line in FIG. 3 refers to an example of a symmetric ssw, A=15°, B=0°.

Figure 4:
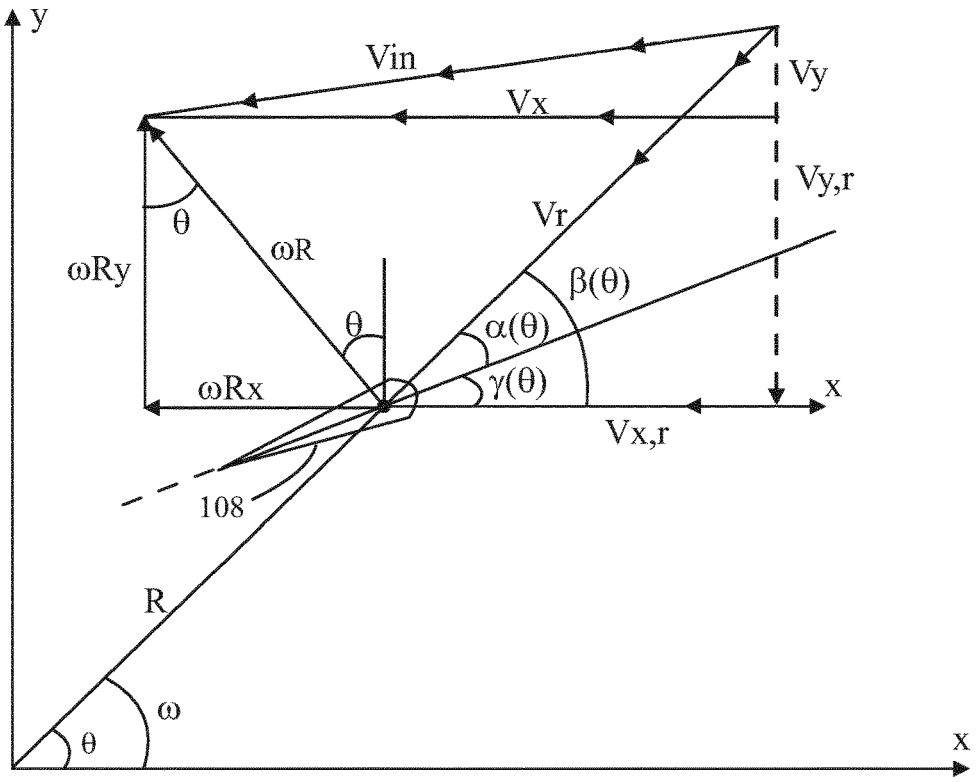
FIG. 4 illustrates an example of a foil rotating at an angular speed at an arbitrary foil location.

FIG. 4 illustrates an example of the foil 108 rotating at an angular speed $\omega$ at an arbitrary foil location expressed as function of the rotation angle $\theta$ of the foil wheel 106. The data on the pitch angle $\gamma(\theta)$ of a foil 108, 108' may be formed such that a target angle of attack $\alpha$ (with chosen amplitude) is attained as closely as possible. Mathematically, the situation can be characterized in a following manner, for example:

$$Vr = Vin - \omega R$$

$$Vr,x = Vx - \omega Rx = Vx + \omega R^{*}\sin(\theta)$$

$$Vr,y = Vy - \omega Ry = Vy - \omega R^{*}\cos(\theta)$$

$$B(\theta) = \mathrm{atan}(Vr,y/Vr,x)$$

$$\gamma(\theta) = \beta(\theta) - \alpha(\theta),$$

where atan( ) is the inverse tangent function (known also as an arcus tangent function), $\alpha(\theta)$ is an angle of attack, $\beta(\theta)$ is a relative velocity angle, $\gamma(\theta)$ is the pitch angle of a foil, Vr is a relative velocity, Vin is a spatially variable inflow velocity of water, i.e. the wake field W, $\omega R$ is a foil velocity, $\omega$ is an angular speed of a foil wheel and R is a radius of a foil wheel. The inflow velocity relative to the foil wheel Vin and the rotational velocity of the foil around the foils wheel Loll comprise the relative velocity $Vr=Vin-\omega R$ towards the foil. Note that both Vin and hence Vr may be assumed to vary with the rotation angle of the foil wheel $\theta$ due to external wake field W from the marine vehicle and/or the wake field W induced by the foils themselves. This relative velocity forms the angle $\beta(\theta)$ with the x-axis. While the pitch angle of a foil is $\gamma(\theta)$, the angle of flow relative to the foil, i.e., the angle of attack becomes $\alpha(\theta)=\beta(\theta)-\gamma(\theta)$ which is equal to the equation $\gamma(\theta)=\beta(\theta)-\alpha(\theta)$.

Writing out the relative velocity flow angle $\beta(\theta)$ and the (symmetric) target angle of attack $\alpha(\theta)$, the pitch angle $\gamma(\theta)$ of a foil 108, 108' may be written as $$\gamma(\theta) = a\tan\left(\frac{V_y^+ - \cos\theta}{V_x^+ + \sin\theta}\right) - \alpha(\theta) = \tan^{-1}\left(\frac{V_y - \omega R\cos\theta}{V_x + \omega R\sin\theta}\right) - A * \cos\left(\theta - \frac{1}{2}\sin(2\theta)\right) \tag{2A}$$

or more conveniently by scaling the relative velocity components by the foil wheel rotational speed $\omega R$ (scaling is optional):

$$\gamma(\theta) = a\tan\left(\frac{V_y^+ - \cos\theta}{V_x^+ + \sin\theta}\right) - A * \cos\left(\theta - \frac{1}{2}\sin(2\theta)\right), \tag{2B}$$

where $V_x^+$ and $V_y^+$ are the scaled contributions or components of the inflow velocity Vin of the wake field Win the directions of the coordinate system x and y. The wake field W contributions may be obtained via particle image velocimetry (PIV) from the actual device, for instance.

Although the measurement with at least on sensor 122 may be possible, the fact that not only is the wake field W required as a function $\theta$ but also exactly at the same instant an angle $\theta$ of the foil wheel 106, 106' is required, may make it challenging. In an embodiment, the wake field W contributions may be recorded from a CFD simulation. This may be accomplished by placing a computational probe 500 adjacent to a foil 108, 108' such that it follows the rotation of the foil wheel 106, 106'. In an embodiment, the computational probe does not the foil pitching and may remain static relative to a pivot point of the foil it follows. In this embodiment, the vector pointing from the pivot point to the probe is always parallel to the x-axis. An example of positioning the computational probes 500 at different foil positions is shown in FIG. 5.

A distance DD between a probe 500 and a corresponding foil 108 adjacent to it may be such that the probe 500 is not be too close to the foil 108 such that the foil itself disturbs the flow adjacent to it too much and not too far such that the correlation between the velocity of the water movement at the probe 500 and at the foil adjacent to it remains high. In an embodiment, a suitable distance DD may be about ¾ chord length in front of the pivot point. More generally, the range of the distance DD may be from about 0.5 to about 1 chord length, for example. In principle, the wake field W should be representative over the foil's span (average in z-direction) but for simplicity it may be assumed that a single point at about the middle is good enough. In the case the wake field W is measured, the at least one sensor 122 may be placed in a corresponding location as the computational probe 500.

The wake field W contributions may have quite complex shapes.

In an embodiment, contributions of the wake field W may be continually iterated within the CFD simulation. The control system, particularly a PID (Proportional Integral Derivative) control system requires a continuous analytical function with at least one continuous derivative. If the wake field W is collected at $\Delta\theta=1°$ intervals, i.e. at every degree of a 360° rotation of the foil wheel 106, 106', from a CFD simulation or from measurements performed by the at least one sensor 122, a discrete Fourier transform may be utilized to form a good model based on continuous trigonometric functions with a total of 360 (full rotation) terms for each wake contribution.

However, feeding such an amount of data on the wake field W to a real machine's control system may be impractical. Furthermore, the real wake field W may not be similar to the simulation in all details. Hence in an embodiment, only a constant average term and/or a few lowest frequency sine and cosine terms from a Fourier series representation of the wake field contributions may be retained. For example three lowest frequency sine and cosine terms may be enough. These truncated functions may then be processed according to Equation (2A) or (2B) in the controller 112, for example. Based on this kind of an algorithm, the controller 112 may form the data on the pitch angle of a foil in a new CFD simulation. Since the wake field W also depends on the pitch angle of a foil, this may be done iteratively in an embodiment. The iterative process may be performed as follows:

1) Initialize the pitch angle of a foil in Equation (2B) with $$V_x^+ = -\frac{V_{x,foil\,wheel}}{\omega R} \text{ and } V_y^+ = 0$$

2) Obtain converged CFD solution and record actual $V_x^+$ and $V_y^+$
3) Form Fourier series representations by retaining the constant and only a few sine and cosine terms
4) Feed a truncated Fourier series representations $V_{x,trunc}^+$ and $V_{y,trunc}^+$ to Equation (1)
5) Obtain a new converged CFD solution and record new actual $V_x^+$ and $V_y^+$
6) Form a new truncated Fourier series representations $V_{x,trunc}^+$ and $V_{y,trunc}^+$
7) Under-relax to avoid overshoot by averaging with the previous round $V_{x,trunc}^+$ and $V_{y,trunc}^+$
8) Return to step 4).

In step 7), too large a change i.e. overshoot should be avoided because a new iterated pitch function also changes the measured $V_x^+$ and $V_y^+$ and large overshoot will slow down or even prevent the convergence of an iterative process. In an embodiment, only two iterative rounds of the steps 1) to 8) may be enough, because beyond that the changes typically become marginal. A comparison of the contributions of a truncated wake field W to actual ones are presented in FIG. 6 and its explanation.

In an embodiment, while the angle of attack $\alpha(\theta)$ is kept constant for a maximized length round the rotation of the foil wheel 106, 106', and the data on the pitch angle $\gamma(\theta)$ is iterated to a single design point (velocity and RPM), the contributions $V_x^+$ and $V_y^+$ of the wake field W may be fixed in Equation (1), which determines the pitch angle $\gamma(\theta)$ of a foil 108, 108'. Then, the pitch trajectory of a foil is fixed regardless of the speed and RPM (Rotation Per Minute), and the foil wheel 106, 106' acts similarly to a fixed pitch screw propeller (or a trochoidal foil wheel with constant eccentricity). If it is assumed that the RPM is constant, at slow speeds the actual angle of attack $\alpha(\theta)$ is large, and a high thrust with reduced efficiency is obtained. As the speed increases towards the designed speed, the actual angle of attack $\alpha(\theta)$ approaches the target behaviour, and a high efficiency is recovered.

However, this behaviour may also be improved in an embodiment. Decompose now a scaled wake field $V_{xy}^+$ into a sum $$V_{xy}^+ = V_{xy,0}^+ + V_{xy,ind}^+ \tag{3}$$

where the scaled wake field $V_{xy}^+$ is expressed as a sum of an undisturbed contribution $V_{xy,0}^+$ without a foil wheel 106, 106', which is with the marine vehicle 100 in self-propulsion situation, real or simulated, and an extra contribution $V_{xy,ind}^+$ induced by the foils 108, 108'.

The undisturbed contribution $V_{xy,0}^+$ of the wake field is directly available since undisturbed speed and RPM are easily obtained. In an embodiment, it may be assumed that velocities of the induced dimensional contribution $V_{xy,ind}$ of the wake field W are locally (at any given $\theta$) directly proportional to the wheel rotational speed $\omega R$. It may be reasonable to assume that the induced velocity is indeed proportional to the velocity inducing it. With this assumption, the scaled induced contributions $V_{xy,ind}^+$ of the wake field W are locally constant but still variable with respect to the angle $\theta$ of a rotation of the foil wheel 106:

$$V_{xy,ind}^+ = (V_{xy}^+ - V_{xy,0}^+)_{design} = \text{locally_constant.} \tag{4}$$

This means that the scaled induced contributions $V_{xy,ind}^+$ of the wake field W are cyclically the same for every rotation of around the rotation axis of the foil wheel 106. Hence, by determining the scaled wake field $V_{xy}^+$ at the design speed and RPM, it is possible to use Equations (3) and (4) to reconstruct a reasonable estimate of the wake field W at any other operating point. Equation (4) is approximate but overall the reconstructed wake field W will give a close match to the target angle of attack $\alpha(\theta)$ at an arbitrary operating point. With the reconstructed wake field W, a high efficiency can be obtained over a wide range of operating points.

While the angle of attack $\alpha(\theta)$ is constant along a maximized length of the rotation of the foil wheel 106, 106', the pitch angle of a foil may reduce the side force. In an embodiment, it is possible to modify the target angle of attack $\alpha(\theta)$ in order to adjust the side force to zero or a large value. In an embodiment, the side force may be adjusted to large value in order to steer the marine vehicle 100 to turn. From the steering perspective, it may however be desirable that the propulsion system 102 has zero or only a weak side force in a straight ahead condition. Both the instantaneous thrust and the side force depend on the corresponding angle of attack $\alpha(\theta)$. Well below the stall angle, a larger angle of attack $\alpha(\theta)$ increases both.

For example, with a constant ±15° angle of attack, the net side force is positive and by increasing the leading side (around $\theta$=0/360°) angle of attack or decreasing the trailing side (around $\theta$=180°) angle of attack, the positive net side force will decrease. For this, an asymmetric constant angle of attack, Equation (1), may be inserted to Equation (2A) or (2B) in place of the symmetric constant angle of attack, and setting A=14° and B=1°, for example. An asymmetric smooth square wave can be obtained with approximately constant value +15° on the leading side and −13° on the trailing side (see FIG. 3). To compensate for the loss of thrust due to a smaller angle of attack on the trailing side, the rotation rate may be increased. With these settings, the iterative process to obtain an approximate wake field W is repeated. An example of the resulting actual angle of attack $\alpha(\theta)$ with the target angle of attack $\alpha(\theta)_{target}$ and the instantaneous foil efficiency are presented in FIG. 6. Again, the actual angle of attack $\alpha(\theta)$ follows the target angle of attack $\alpha(\theta)_{target}$ quite well, and high efficiency levels are maintained. The performance results behave as expected. The efficiency is further increased and the side force is reduced compared with the prior art in this optimization example, but the thrust is slightly reduced. The reduced thrust may be compensated with a further increase in rotation rate or by adjusting the asymmetry a bit down, say to A=14.1 and B=0.9°. The central performance figures of this +15°/−13° asymmetric constant angle of attack case are listed in Table 1. For reference, the corresponding performance figures of the symmetric +15°/−15° constant angle of attack case are listed in Table 2.

TABLE 1

Performance of an example of the asymmetric constant angle of attack (+15°/−13°)

| P (MW) | Fx (kN) | Fy (kN) | $\eta$ | D (m) | RPM | $\alpha$ (°) |
|---|---|---|---|---|---|---|
| 1.838 | 164.2 | −7.0 | 0.850 | 3.0 | 38.14 | +15/−13 |

In Tables 1 and 2, P denotes power, Fx and Fy are forces in directions of the orthogonal axes x and y, $\eta$ denotes efficiency of the propulsion system, D denotes a diameter of the foil wheel, RPM denotes foil wheel's rotations per minute and denotes $\alpha$ the angle of attack.

TABLE 2

Performance of the constant angle of attack (±15°) foil pitch trajectory case

| P [MW] | Fx [kN] | Fy [kN] | $\eta$ | D[m] | RPM | $\alpha$ |
|---|---|---|---|---|---|---|
| 1.933 | 172.3 | 28.5 | 0.849 | 3.0 | 37.14 | ±15° |

By optimizing the pitch angle $\gamma(\theta)$ with the wake field W leads to both a high efficiency and a small side force when propagating straight ahead.

The inclusion of the local, variable wake field W allows to achieve even a very high efficiency, of order 85%. In addition to a constant angle of attack formulation, it is possible to achieve similar efficiency levels by expressing the pitch function $\gamma(\theta)$ as a series of periodic functions and optimizing the coefficients by using the local, variable wake field W as an input to the optimization. In this manner, the underlying physics can be linked to the optimization more broadly which in turn allows to reach for a high efficiency more generally.

As an example of the optimization of the pitch angle $\gamma(\theta)$, it may be expressed in a mathematical form in a following manner. Denote pitch function parameters by $X=(X_1, \ldots, X_N)$ which may be considered the data related to the pitch angle, an objective functions by E, and constraint functions by C. The parameters X, objective function E and constraint function C may be considered vectors when the controller 112 performs the algorithm. The optimization problem may be described as below:

The object function is maximized or optimized using Max operator, Max E(X). The constraint function is subjected to limitations, $C_U \geq C(X) \geq C_L$, where $C_U$ and $C_L$ are the higher and lower bound(s) for C, respectively.

The pitch function parameters may have limits: $X_L \leq X \leq X_U$, where $X_L$ and $X_U$ are the lower and higher bounds for X, respectively.

Here the objective function E and constraint function C relate to the foil foil wheel performance variables like thrust, side force, and efficiency, for example. The optimization objective may maximize the efficiency (E) with constraint on thrust (C); or maximize thrust (E) with efficiency (C) larger than a set value.

The pitch angle $\gamma(\theta)$ can be calculated from the pitch function parameters X: $\gamma(\theta)=f(X)$, where f(X) is a periodic function of the angular position $\theta$ with k continuous derivatives, where $k \geq 2$ to have a smooth curve and avoid rapid changes of the blade orientation considering moment limits of the blade motor. The periodic function f(X) could be expressed using at least one spline function, for example. The spline functions are functions that may be defined by polynomials in a piecewise manner. The periodic function f(X) could include at least one elementary function that is at least two times derivable, for example.

When a wake field W is included in the optimization, the optimization problem can be performed as follows. The object function E is maximized or optimized using Max operator, Max E(X,W). The constraint function is subjected to limitations, $C_U \geq C(X) \geq C_L$, where $C_U$ and $C_L$ are the higher and lower bound(s) for C, respectively, $C_U \geq C(X) \geq C_L$, where $C_U$ and $C_L$ are the higher and lower bound(s) for C, respectively. Limits of the pitch function parameters depend on eventual operational conditions and application. For example, for a normal trochoidal-like operation the derived angle of attack should be restricted from a stall mode.

In an embodiment, the controller 112 may form the data on the pitch angle $\gamma(\theta)$ by optimizing an efficiency and/or a thrust of a model formed of a set of second-order continuous periodic functions of the pitch angle $\gamma(\theta)$, having an angle of attack $\alpha$ and the wake field W as its arguments with or without an operational demand and/or a constraint. The second order continuous periodic function refers to a function that have the first and second derivatives.

In an embodiment, the controller 112 may form the data on the pitch angle $\gamma(\theta)$ by maximizing an efficiency and/or a thrust of a model formed of a set of second-order continuous periodic functions of the pitch angle $\gamma(\theta)$.

In an embodiment, the controller 112 may receive or have available data on a location of the marine vehicle 100, other marine vehicles, wind conditions, and/or tide, for example, and the controller 112 may utilize the received data in the formation of the pitch angle $\gamma(\theta)$. The data on the location may include information on streams, which are caused by a river or rivers nearby at the location, and/or a map of the bottom at the location, and the controller 112 may estimate the wake field W based on at least one of them. The controller 112 may additionally or alternatively estimate the wake field W based on the wind and/or tidal conditions.

Figure 7:
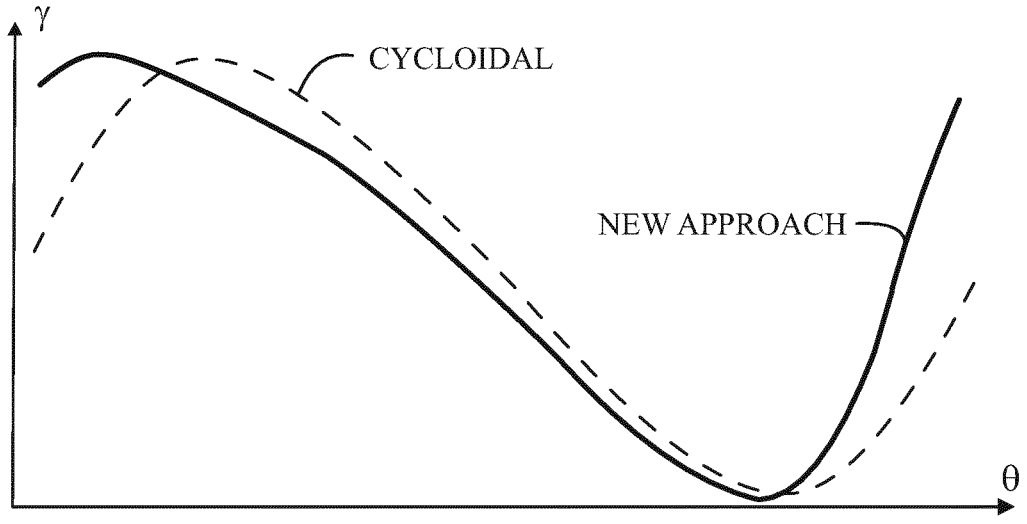
FIG. 7 illustrates an example of a pitch angle trajectory of a foil with respect to a rotation angle of the foil wheel.

While forming the pitch angle $\gamma(\theta)$ in the above explained manner, the pitch angle $\gamma(\theta)$ becomes unconventional and an optimum hydrodynamical performance may be achieved. FIG. 7 illustrates an example of a pitch angle trajectory of a foil with respect to a rotation angle of the foil wheel in an arbitrary but common scale. The x-axis represents the rotation angle $\theta$ of the foil wheel and the y-axis represents the pitch angle $\gamma$. It can be seen that the new approach explained in this document may result in a different trajectory from that of a cycloidal foil pitch trajectory that is conventional.

Figure 8:
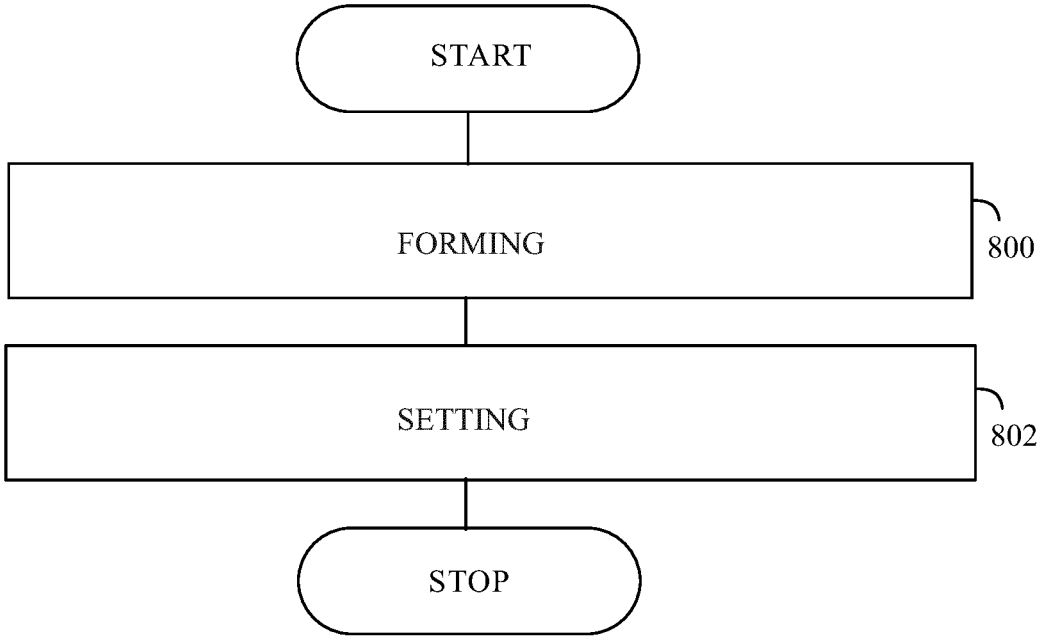
FIG. 8 illustrates of an example of a flow chart of a controlling method.

FIG. 8 is a flow chart of the controlling method. In step 800, forming data on a pitch angle $\gamma(\theta)$ of at least one foil 108, 108', which is individually controllable and in a rotatable manner attached with a foil wheel 106, 106', based on an angularly variable wake field $W(\theta)$ affecting the at least one foil 108, 108' and an angle $\theta$ of a rotation of the foil wheel 106, 106' is formed by a controller 112. In step 802, the at least one foil 108, 108' is set at the pitch angle $\gamma(\theta)$ based on the data by an actuator arrangement 110 receiving the data from the controller 112.

The method shown in FIG. 7 may be implemented as a logic circuit solution or computer program. The computer program may be placed on a computer program distribution means for the distribution thereof. The computer program distribution means is readable by a data processing device, and it encodes the computer program commands, carries out the measurements and optionally controls the processes on the basis of the measurements.

The computer program may be distributed using a distribution medium which may be any medium readable by the controller. The medium may be a program storage medium, a memory, a software distribution package, or a compressed software package. In some cases, the distribution may be performed using at least one of the following: a near field communication signal, a short distance signal, and a telecommunications signal.

The improvements and benefits of the formation of the pitch angle of the foil trajectory as a function of the wake field W may be the following. During the formation of the pitch angle, the angle of attack that may be kept constant or in a constant range for a maximized length of the rotation of the foil wheel.

1) High gains in efficiency up to $\eta=0.85$;

2) Direct link to physics (the wake field) allows utilization of design point parameters over the whole operating range unlike parametrically optimized pitch trajectories;

3) The optimal performance of parametrically optimized trajectories is restricted to open water conditions, whereas the constant angle of attack trajectory becomes optimal with the marine vehicle when the utilized wake field is recorded from a CFD simulation or measurement;

4) Ability to adjust side force to zero without loss of efficiency (with the asymmetric angle of attack $\alpha_{target}$) in straight ahead operation;

5) Avoid flow separation/stall induced losses in thrust and efficiency (angle of attack is controlled);

6) A "high thrust" mode is obtained simply by increasing the amplitude of the angle of attack $\alpha_{target}$ (not over the stall angle).

It will be obvious to a person skilled in the art that, as technology advances, the inventive concept can be implemented in various ways. The invention and its embodiments are not limited to the example embodiments described above but may vary within the scope of the claims.

The invention claimed is:

1. A method of controlling a propulsion system of a marine vehicle, comprising:

decomposing a scaled wake field into a sum of an undisturbed contribution and an extra contribution induced by at least one foil;

setting the induced scaled contribution caused by every foil constant;

determining an angularly variable wake field (W(θ)) at least approximately based on the induced scaled contribution that is locally constant:

forming, by a controller, data on a pitch angle (γ(θ)) of the at least one foil, which is individually controllable and in a rotatable manner attached with a foil wheel, based on the angularly variable wake field (W(θ)) affecting the at least one foil and an angle (θ) of a rotation of the foil wheel; and setting, by an actuator arrangement receiving the data from the controller, the at least one foil at the pitch angle (γ(θ)) based on the data.

2. The method of claim 1, wherein said forming the data on the pitch angle (γ(θ)) of the at least one foil is performed under influence of the angularly variable wake field (W(θ)), which is caused by propulsion of the propulsion system.

3. The method of claim 2, wherein said forming the data on the pitch angle (γ(θ)) of the at least one foil comprises forming the data on the pitch angle (γ(θ)) of a foil of the at least one foil under influence of the angularly variable wake field (W(θ)), which is caused by at least one other foil, which is different from the foil for which the data on the pitch angle is formed, the at least one foil being attached to the foil wheel to which the foil for which the data on the pitch angle is formed is also attached.

4. The method of claim 1, wherein said forming the data on the pitch angle (γ(θ)) of the at least one foil is performed under influence of the angularly variable wake field (W(θ)), which is caused by a hull of the marine vehicle.

5. The method of claim 1, wherein said forming the data on the pitch angle (γ(θ)) of the at least one foil is performed under influence of the angularly variable wake field (W(θ)), which is caused by environment of the marine vehicle.

6. The method of claim 1, wherein said forming the data on the pitch angle (γ(θ)) of the at least one foil comprises forming the data on the pitch angle (γ(θ)) for each of a plurality of foils individually controllable and attached in a rotatable manner with the foil wheel.

7. The method of claim 1, wherein said forming the data on the pitch angle (γ(θ)) of the at least one foil is performed under influence of the angularly variable wake field (W(θ)) caused by a plurality of propulsion sub-systems of the propulsion system, the propulsion sub-systems including foils attached therewith including the at least one foil.

8. The method of claim 1, wherein the angularly variable wake field (W(θ)) is based on a simulation of the propulsion system in the water.

9. The method of claim 1, further comprising:

measuring the angularly variable wake field (W(θ)) with at least one sensor when the marine vehicle is in the water, and communicating data on the angularly variable wake field (W(θ)) to the controller.

10. The method of claim 1, wherein said forming the data on the pitch angle (γ(θ)) of the at least one foil is performed while keeping an absolute angle of attack (α) of the at least one foil constant within a tolerance for a maximized length of rotation of the foil wheel.

11. The method of claim 1, wherein said forming the data on the pitch angle (γ(θ)) of the at least one foil is performed while keeping an angle of attack (α) of the at least one foil at two alternative constants within a tolerance for a maximized length of rotation of the foil wheel, the constants having opposite signs.

12. The method of claim 1, wherein said forming the data on the pitch angle (γ(θ)) of the at least one foil is performed by optimizing an efficiency and/or a thrust of a model formed of a set of second-order continuous periodic functions of the pitch angle (γ(θ)), angle of attack (α) and the angularly variable wake field (W(θ)) with or without an operational demand and/or a constraint.

13. A propulsion system of a marine vehicle, the propulsion system comprising:

a foil wheel, at least one foil, which is individually controllable and in a rotatable manner attached with the foil wheel, an actuator arrangement and a controller;

the controller comprising one or more processors and one or more memories including computer program code;

the one or more memories and the computer program code configured to, with the one or more processors, cause at least the controller to:

decompose a scaled wake field into a sum of an undisturbed contribution and an extra contribution induced by at least one foil, set the induced scaled contribution caused by every foil constant, determine an angularly variable wake field (W(θ)) at least approximately based on the induced scaled contribution that is locally constant, form data on a pitch angle (γ(θ)) of the at least one foil based on an angle (θ) of a rotation of the foil wheel and the angularly variable wake field (W(θ)) affecting the at least one foil, and communicate the data on the pitch angle (γ(θ)) to the actuator arrangement, which is configured to set the at least one foil at the pitch angle (γ(θ)) based on the data.

14. A marine vehicle comprising a propulsion system having:

a foil wheel, at least one foil, which is individually controllable and in a rotatable manner attached with the foil wheel, an actuator arrangement and a controller;

the controller including one or more processors and one or more memories including computer program code;

the one or more memories and the computer program code configured to, with the one or more processors, cause at least the controller to:

decompose a scaled wake field into a sum of an undisturbed contribution and an extra contribution induced by at least one foil, set the induced scaled contribution caused by every foil constant;

determine an angularly variable wake field (W(θ)) at least approximately based on the induced scaled contribution that is locally constant, form data on a pitch angle (γ(θ)) of the at least one foil based on an angle (θ) of a rotation of the foil wheel and the angularly variable wake field (W(θ)) affecting the at least one foil, and communicate the data on the pitch angle (γ(θ)) to the actuator arrangement, which is configured to set the at least one foil at the pitch angle (γ(θ)) based on the data.

15. The method of claim 1, wherein the at least one foil is a blade, and wherein the angularly variable wake field (W(θ)) is based on a simulation of the propulsion system in the water with a computational probe adjacent to the at least one foil or measuring the angularly variable wake field (W(θ)) with at least one sensor adjacent to the at least one foil when the marine vehicle is in the water, and communicating data on the angularly variable wake field (W(θ)) to the controller.

16. A method of controlling a propulsion system of a marine vehicle having a foil wheel and at least one foil, comprising:

decomposing a scaled wake field, which affects the at least one foil and an angle (θ) of a rotation of the foil wheel, into a model based on a sum of an undisturbed contribution and an extra contribution induced by at least one foil;

truncating functions of the induced scaled contributions caused by every foil;

determining an angularly variable wake field (W(θ)) at least approximately based on the contributions of the truncated functions;

forming, by a controller, data on a pitch angle (γ(θ)) of the at least one foil, which is a blade and is individually controllable and in a rotatable manner attached with the foil wheel, based on the angularly variable wake field (W(θ)); and setting, by an actuator arrangement receiving the data from the controller, the at least one foil at the pitch angle (γ(θ)) based on the data.

17. A propulsion system of a marine vehicle, the propulsion system comprising:

a foil wheel, at least one foil, which is individually controllable and in a rotatable manner attached with the foil wheel, an actuator arrangement and a controller;

the controller comprising one or more processors and one or more memories including computer program code;

the one or more memories and the computer program code configured to, with the one or more processors, cause at least the controller to:

decompose a scaled wake field, which affects the at least one foil and an angle (θ) of a rotation of the foil wheel, into a model based on a sum of an undisturbed contribution and an extra contribution induced by at least one foil, truncate functions of the induced scaled contributions caused by every foil, determine an angularly variable wake field (W(θ)) at least approximately based on the contributions of the truncated functions, form, by a controller, data on a pitch angle (γ(θ)) of the at least one foil, which is a blade and is individually controllable and in a rotatable manner attached with the foil wheel, based on the angularly variable wake field (W(θ)), and communicate the data on the pitch angle (γ(θ)) to the actuator arrangement, which is configured to set the at least one foil at the pitch angle (γ(θ)) based on the data.

* * * * *